US012253299B2

(12) United States Patent
Cui et al.

(10) Patent No.: US 12,253,299 B2
(45) Date of Patent: Mar. 18, 2025

(54) REFRIGERATOR

(71) Applicants: HEFEI HAIER REFRIGERATOR CO., LTD, Anhui (CN); QINGDAO HAIER REFRIGERATOR CO., LTD., Shandong (CN); HAIER SMART HOME CO., LTD., Shandong (CN)

(72) Inventors: Zhanpeng Cui, Shandong (CN); Jiaming Li, Shandong (CN); Lisheng Ji, Shandong (CN); Peng Lv, Shandong (CN)

(73) Assignees: HEFEI HAIER REFRIGERATOR CO., LTD, Anhui (CN); QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 86 days.

(21) Appl. No.: 18/025,220

(22) PCT Filed: Aug. 26, 2021

(86) PCT No.: PCT/CN2021/114767
§ 371 (c)(1),
(2) Date: Mar. 8, 2023

(87) PCT Pub. No.: WO2022/057591
PCT Pub. Date: Mar. 24, 2022

(65) Prior Publication Data

US 2023/0258390 A1 Aug. 17, 2023

(30) Foreign Application Priority Data

Sep. 15, 2020 (CN) ..... 202010970284.2

(51) Int. Cl.
*F25D 23/04* (2006.01)
*F25D 11/02* (2006.01)
*F25D 23/02* (2006.01)
*F25D 23/06* (2006.01)

(52) U.S. Cl.
CPC ..... *F25D 23/04* (2013.01); *F25D 11/02* (2013.01); *F25D 23/025* (2013.01);
(Continued)

(58) Field of Classification Search
CPC ..... F25D 23/04; F25D 11/02; F25D 23/068; F25D 2323/02; F25D 2317/0411;
(Continued)

(56) References Cited

U.S. PATENT DOCUMENTS 3,004,400 A * 10/1961 Mann ..... F25D 17/065 62/187
4,369,632 A * 1/1983 Abraham ..... F25D 21/125 62/282

(Continued)

FOREIGN PATENT DOCUMENTS

CN 105444489 A 3/2016
CN 109990527 A 7/2019

(Continued)

OTHER PUBLICATIONS

Chinese Intellectual Property Office (ISR/CN), "International Search Report for PCT/CN2021/114767", China, Nov. 17, 2021.

*Primary Examiner* — Hiwot E Tefera
(74) *Attorney, Agent, or Firm* — troutman pepper locke; Tim Tingkang Xia, Esq.

(57) ABSTRACT

A refrigerator, comprising a refrigerator body defining a first chamber and a door body. The door body comprises a main door for opening/closing the first chamber, and defining a second chamber, and a secondary door for opening/closing the second chamber. An air supply port for introducing air in (Continued)

the first chamber into the second chamber, and an air return port for returning air in the second chamber to the first chamber are provided on a rear wall of the main door. The second chamber is provided with a dry storage portion. The rear wall of the main door comprises a front shell and a rear shell with an air duct defined therebetween. The air duct introduces cold air prepared in the refrigerator, so that the cold air is condensed on an inner wall of the air duct, becomes dry gas, and then flows into the dry storage portion.

9 Claims, 4 Drawing Sheets

(52) U.S. Cl.
CPC ..... *F25D 23/028* (2013.01); *F25D 23/068* (2013.01); *F25D 2317/061* (2013.01); *F25D 2317/062* (2013.01); *F25D 2323/02* (2013.01)

(58) Field of Classification Search
CPC ..... F25D 2317/0413; F25D 2317/061; F25D 2317/062; F25D 17/042; F25D 23/025; F25D 23/02; F25D 23/028
See application file for complete search history.

(56) References Cited

U.S. PATENT DOCUMENTS 5,979,174 A * 11/1999 Kim ..... F25D 17/065 62/413
5,996,370 A * 12/1999 Lee ..... F25D 17/062 62/DIG. 13
6,138,432 A * 10/2000 Banicevic ..... F25D 23/02 312/405.1
7,076,967 B2 * 7/2006 Lee ..... F25C 5/046 62/353
8,074,464 B2 * 12/2011 Venkatakrishnan .. F25D 17/065 62/344
9,587,876 B1 * 3/2017 Powell ..... F25D 23/028
2005/0210909 A1 * 9/2005 Kim ..... F25D 23/12 62/340
2009/0113923 A1 * 5/2009 Young ..... F25D 17/065 700/282
2010/0257877 A1 * 10/2010 Yun ..... F25D 17/065 62/340
2012/0085120 A1 * 4/2012 Davis ..... F25D 17/065 277/315
2015/0107291 A1 * 4/2015 Mitchell ..... F25D 17/065 62/340
2018/0335246 A1 * 11/2018 Jeong ..... F25D 23/126
2019/0264974 A1 * 8/2019 Mitchell ..... F25D 17/062
2023/0066886 A1 * 3/2023 Wirth ..... A47F 3/0447

FOREIGN PATENT DOCUMENTS

CN 109990531 A 7/2019
CN 109990532 A 7/2019
CN 213514586 U 6/2021
KR 20160045316 A 4/2016
WO WO-2004059228 A1 * 7/2004 ..... F25D 17/045

* cited by examiner

REFRIGERATOR

CROSS-REFERENCE TO RELATED PATENT APPLICATION

This application is a U.S. national stage application of PCT Patent Application No. PCT/CN2021/114767 filed Aug. 26, 2021, which claims priority to and the benefit of Chinese Application No. 202010970284.2 filed Sep. 15, 2020, which are incorporated herein in their entireties by reference.

FIELD OF THE INVENTION

The present invention relates to the technical field of refrigeration and freezing, and in particular to a refrigerator.

BACKGROUND OF THE INVENTION

With the advancement of technology and the improvement of people's living standards, users have higher and higher requirements for refrigerators. The traditional refrigerators with only a refrigerating room, a freezing room and a temperature-variable room can no longer meet users' diverse needs for storage space.

In recent years, a composite door body technology has emerged in the field of refrigerators. As is well-known to all, a traditional refrigerator door body is used to open and close a refrigeration chamber of a refrigerator body. At most, a bottle holder is disposed at an inner lining of the refrigerator door body for placing bottled articles. As for the refrigerator with the composite door body, the structure and functions of the door body are improved, which makes the door body include a main door and a secondary door, and enables the main door to be used for opening and closing the refrigeration chamber. In addition, the main door defines a door body chamber with an open front side, and the secondary door is used to open and close the door body chamber. The secondary door remains closed during rotation of the main door. The door body chamber can be used for placement of stored articles, and only the secondary door needs to be opened when taking and placing the stored articles, without opening the main door. It not only makes the operation more convenient and faster, but also avoids excessive cold energy loss caused by frequent opening of the main door.

However, the refrigerator with the composite door also has many defects. For example, the space of the door body chamber is too small, so that the temperature and humidity thereof are not easy to control; the storage conditions of the door body chamber are similar to those of the refrigerating room, or even the door body chamber completely communicates with the refrigerating room to become a part of the refrigerating room. These problems will have a negative impact on user experience and hinder the further development of the composite door technology.

BRIEF DESCRIPTION OF THE INVENTION

An object of the present invention is to solve at least one of the above-mentioned defects existing in the prior art, enrich the storage function of a door body chamber in a refrigerator with a composite door, and meet the higher requirements of users for the storage function of a door body.

A further object of the present invention is to complete the separation and extraction of dry and wet cold air in the door body.

In particular, the present invention provides a refrigerator, including a refrigerator body and a door body, where a front side of the refrigerator body is open to define a first chamber, and the door body includes a main door used for opening and closing the first chamber, and defining a second chamber, and a secondary door used for opening and closing the second chamber, where a rear wall of the main door is provided with an air supply port used for introducing air in the first chamber into the second chamber, and an air return port used for allowing to return air in the second chamber to the first chamber, the second chamber being internally provided with a dry storage portion;

the rear wall of the main door includes a front shell and a rear shell spaced apart from each other front and back, and an air duct is defined between the front shell and the rear shell; and the air duct is configured to introduce cold air prepared in the refrigerator, so that the cold air is condensed on an inner wall of the air duct, becomes dry gas, and then flows into the dry storage portion.

Optionally, the second chamber is internally provided with a moisture storage portion; furthermore, an atomizing device is disposed downstream of the air duct to atomize condensed water accumulated by condensation on the inner wall of the air duct; and the air duct is configured to introduce the cold air mixed with mist into the moisture storage portion.

Optionally, the air duct is internally provided with an air baffle, and communication points between the dry storage portion and the air duct as well as between the moisture storage portion and the air duct are respectively located upstream and downstream of the air baffle; and the air baffle is spaced apart from the rear shell to allow condensation water and part of the cold air to flow in a downstream direction of the air baffle.

Optionally, the dry storage portion is configured to return air to the second chamber; and an internal space of the moisture storage portion is isolated from the second chamber.

Optionally, a front air outlet communicated with a cooling room of the refrigerator is formed in an inner wall of the refrigerator body, and the front air outlet is adjacent to the rear shell to discharge air toward a rear surface of the rear shell, so that the rear shell is cooled.

Optionally, the front air outlet is reserved in a front part of a top wall of the refrigerator body.

Optionally, a rear air outlet communicated with the cooling room is formed at a rear side of the refrigerator body to supply air to a rear part of the first chamber.

Optionally, the air supply port is located at a top of the rear wall, and a top of the air duct is communicated with the air supply port to allow the cold air of the first chamber to enter the second chamber and the air duct through the air supply port.

Optionally, the front air outlet communicated with the cooling room of the refrigerator is formed in the front part of the top wall of the refrigerator body, and the front air outlet is configured to supply air to the rear surface of the rear shell and the air supply port at the same time.

Optionally, the rear shell is made of a metal material.

According to the refrigerator provided by the present invention, the dry storage portion is to disposed in the door body chamber (i.e., the second chamber), and can be specially used to store articles that need to be dried and refrigerated, thus enriching the storage function of the second chamber, making the second chamber more usable, meeting the users' higher requirements for the storage function of the door body, and further improving the user experience.

Further, according to the present invention, in particular, the air duct is disposed in the rear wall of the main door, and the cold air is introduced into the dry storage portion through the air duct. When the cold air flows through the air duct, the water vapor in the cold air condenses on the inner wall of the air duct, so that the stripping of moisture is realized, and the cold air flowing into the dry storage portion is dry air. Due to adoption of such a simple structure, the present invention completes a drying process during the delivery of the cold air to the dry storage portion; and the water vapor naturally condenses in the drying process, and no other additional structures are required, so that the design is very ingenious. Moreover, the second chamber is formed in the main door, its volume is very limited, and the volume of the dry storage portion is smaller, so there is no need for the air duct to have a very large flow area. Therefore, formation of the air duct has little effect on the thickness of the rear wall of the main door, and will not occupy the storage space of the second chamber.

Further, according to the refrigerator provided by the present invention, the second chamber is internally provided with not only the dry storage portion but also the moisture storage portion for storing refrigerated articles that require an environment with higher humidity. Moreover, the present invention uses the atomizing device to atomize the condensation of the air duct, so that the atomized condensation humidifies the cold air in the air duct and the humidified cold air is supplied to the moisture storage portion. This process just recycles and utilizes the condensed water produced in a dry air preparation process, which realizes the organic combination of a drying process and a humidification process of the cold air, thus achieving the separation and extraction of dry and wet cold air, and omitting the additional dehumidification and humidification structure design as well as control program design; and therefore, the present invention is lower in cost, better in the effect, and suitable for mass production promotion. In addition, the more condensation during the drying process, the drier the obtained dry air; and furthermore, the more condensed water accumulated, the wetter the finally obtained humidified air. It can be seen that the drying process and the humidification process of the cold air are in a mutually promoting relationship, so that the drying and humidifying effects are very good.

Further, the refrigerator provided by the present invention also uses the air discharged out from the front air outlet formed in the inner wall of the refrigerator body to cool the rear surface of the rear shell, so that the temperature of the rear shell is lower, the condensation process of the front surface of the rear shell (i.e., the rear wall of the air duct) is facilitated, and the cold air supplied to the dry storage portion is accordingly drier. In addition, the air discharged out from the front air outlet cools the front space of the first chamber while cooling the rear surface of the rear shell, thus avoiding unfavorable cooling of the front space of the first chamber caused by only supplying air to the rear wall of the refrigerator body.

The above and other objectives, advantages, and features of the present invention will be better understood by those skilled in the art according to the following detailed description of specific embodiments of the present invention in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In the drawings.

DETAILED DESCRIPTION

A refrigerator according to an embodiment of the present invention will be described below with reference to FIGS. 1 to 4. The orientations or positional relationships indicated by "front," "rear," "upper," "lower," "top," "bottom," "inside," "outside," "transverse," etc. are based on the orientations or positional relationships shown in the accompanying drawings, only for the convenience of describing the present invention and simplifying the description, rather than indicating or implying that a device or an element referred to must has a particular orientation, and be constructed and operated in the particular orientation, and therefore cannot be construed as a limitation of the present invention.

Figure 1:
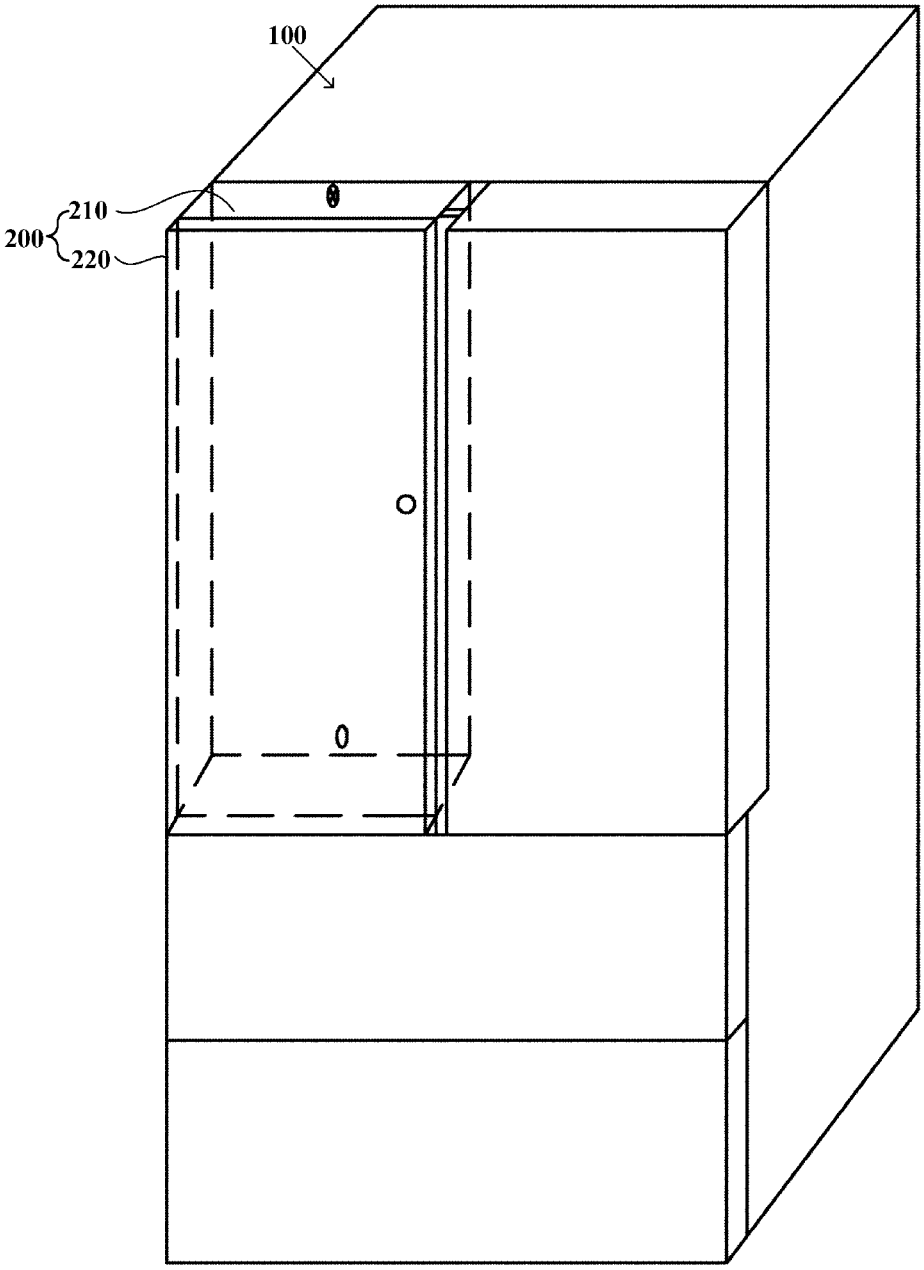
FIG. 1 is a schematic diagram of a structure of a refrigerator according to an embodiment of the present invention.
Figure 2:
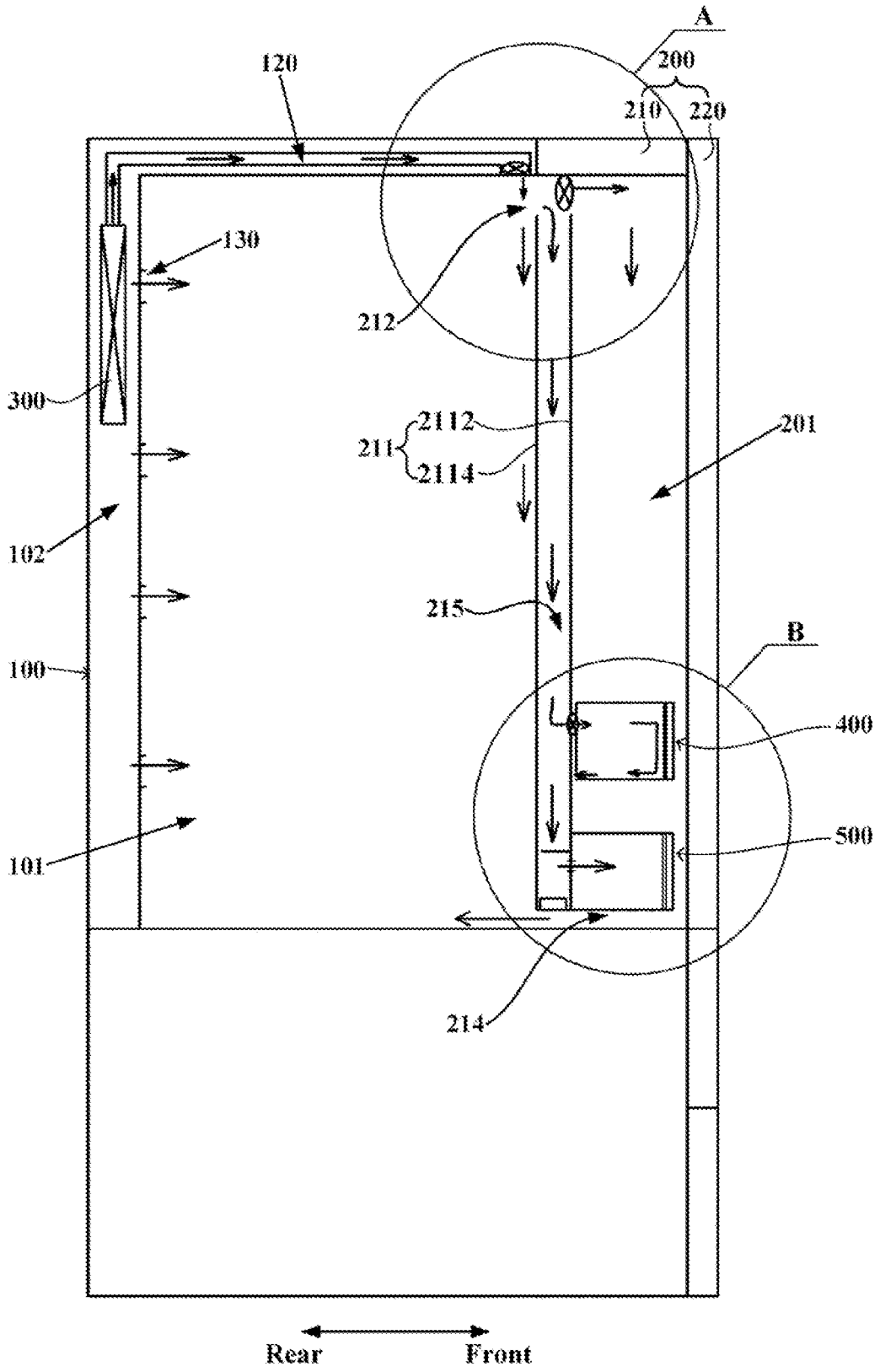
FIG. 2 is a schematic diagram of an air path circulation of the refrigerator shown in FIG. 1.
Figure 3:
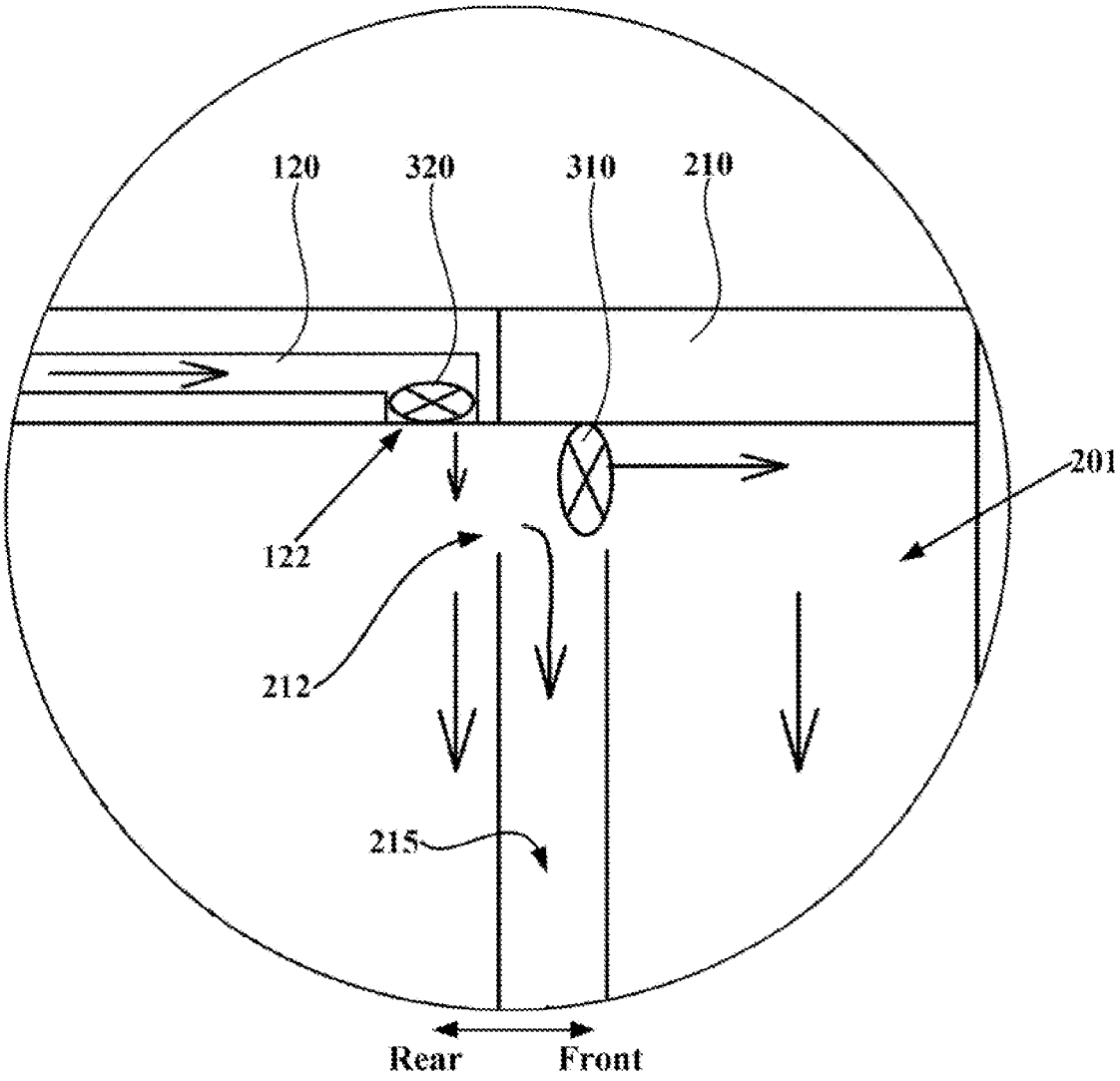
FIG. 3 is an enlarged view at A in FIG. 2.
Figure 4:
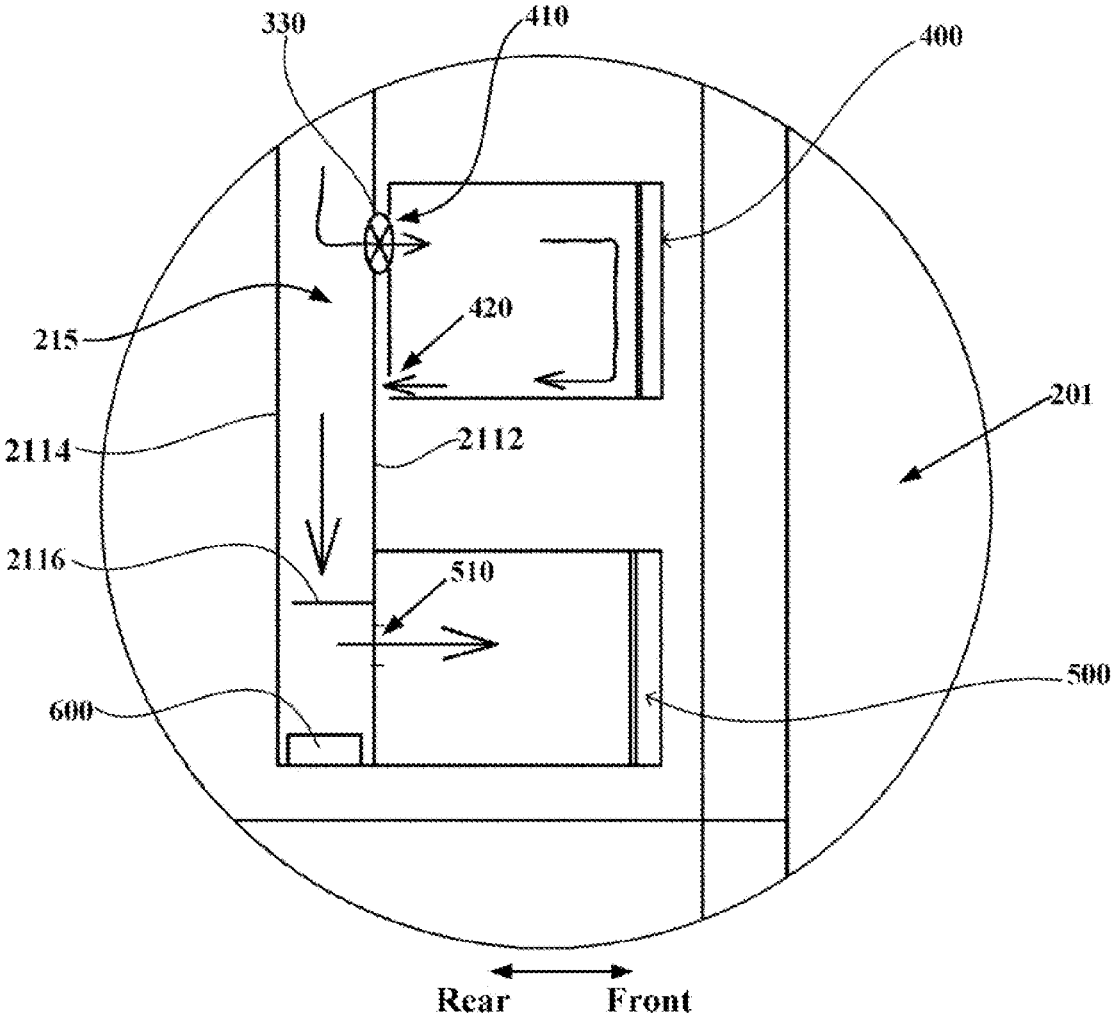
FIG. 4 is an enlarged view at B in FIG. 2.

FIG. 1 is a schematic diagram of a structure of a refrigerator according to an embodiment of the present invention; FIG. 2 is a schematic diagram of an air path circulation of the refrigerator shown in FIG. 1; FIG. 3 is an enlarged view at A in FIG. 2; and FIG. 4 is an enlarged view at B in FIG. 2, and air directions are indicated by arrows in the figures.

As shown in FIGS. 1 to 4, the refrigerator according to the embodiment of the present invention may generally include a refrigerator body 100 and a door body 200. A front side (the side where the door body 200 is located is used as the front side of the refrigerator provided by the present invention, and the front and rear directions have been shown in the figures) of the refrigerator body 100 is open to define a first chamber 101. The door body 200 includes a main door 210 and a secondary door 220, where the main door 210 is used for opening and closing the first chamber 101, and defining a second chamber 201, and the secondary door 220 is used for opening and closing the second chamber 201.

The main door 210 can be rotatably installed on the refrigerator body 100 at the front side of the refrigerator body 100, a front side of the main door 210 is open to define the aforementioned second chamber 201, and the secondary door 220 can be rotatably installed on the main body 210 at the front side of the main door 210. When the main door 210 is opened, a user accesses articles from the first chamber 101. When the main door 210 is closed and the secondary door 220 is opened, the user can access articles from the second chamber 201.

The refrigerator can be refrigerated by a vapor compression refrigeration cycle system, a semiconductor refrigeration system or other means. According to different refrigeration temperatures, all chambers inside the refrigerator can be divided into a refrigerating room, a freezing room and a temperature-variable room. For example, the temperature in the refrigerating room is generally controlled within a range of 2° C. to 10° C., preferably 4° C. to 7° C. The temperature range in the freezing room is generally controlled at −22° C. to −14° C. The temperature-variable room can be adjusted within a temperature range of −18° C. to 8° C. to achieve a variable temperature effect. Different types of articles are different in optimal storage temperatures and storage chambers suitable for storage. For example, fruit and vegetable foods are suitable for storage in the refrigerating room, and meat foods are suitable for storage in the freezing room. The first chamber 101 in the embodiment of the present invention is preferably a refrigerating room.

As shown in FIGS. 2 to 4, a rear wall 211 of the main door 210 is provided with an air supply port 212 used for introducing air in the first chamber 101 into the second chamber 201, and an air return port 214 used for allowing to return air in the second chamber 201 to the first chamber 101. In other words, the rear wall 211 is provided with the air supply port 212 and the air return port 214, where the air supply port 212 is used for supplying air from the first chamber 101 to the second chamber 201, and the air return port 214 is used for returning air from the second chamber 201 to the first chamber 101, thus achieving the refrigeration of the second chamber 201. A first fan 310 can be installed at the air supply port 212 to blow cold air to the second chamber 201.

The second chamber 201 is internally provided with a dry storage portion 400. The rear wall 211 of the main door 210 includes a front shell 2112 and a rear shell 2114 spaced apart from each other front and back, and an air duct 215 is defined between the front shell and the rear shell. A front surface of the front shell 2112 constitutes the rear wall 211 face of the second chamber 201, and a rear surface of the rear shell 2114 constitutes the rearmost side surface of the main door 210. The front shell 2112 and the rear shell 2114 can be different parts that need to be assembled later, or can be an integrally-formed part. The air duct 215 is configured to introduce cold air prepared in the refrigerator, so that the cold air is condensed on an inner wall of the air duct 215, becomes dry gas, and then flows into the dry storage portion 400. The dry storage portion 400 may be provided with a dry air inlet 410 to introduce the dry air in the air duct 215, and a fan 330 may be installed at the dry air inlet 410 for promoting the dry air to flow to the dry storage portion 400. The dry storage portion 400 may be a drawer.

The inventor has found that since the rear wall 211 of the main door 210 is in direct contact with the first chamber 101, the temperature of the rear wall 211 of the main door 210 is lower than those of other parts of the main door 210. Therefore, formation of the air duct 215 in the rear wall 211 of the main door 210 is most conducive to the generation of condensation. In the embodiment of the present invention, the rear shell 2114 is also preferably made of a metal material; and because the metal material has better heat transfer performance, the temperature of the metal material is lower, which is conducive to the formation of condensation on the front surface (i.e., the inner wall of the air duct 215) of the rear shell 2114. The front shell 2112 can be made of a non-metallic material with better thermal insulation performance, so as to maintain a low temperature environment in the air duct 215 and reduce the influence of the temperature of the second chamber 201 (which is higher than the temperature of the first chamber 101) on the temperature of the air duct 215.

According to the embodiment of the present invention, the introduction of dry gas makes the relative humidity of the air in the dry storage portion 400 very low, so that the dry storage portion 400 can be specially used for storing articles (such as medicines) that need to be dried and refrigerated; and therefore, the storage function of the second chamber 201 is enriched, and the usability of the second chamber 201 is enhanced, which satisfies the user's higher requirements for the storage function of the door body, and improves the user experience.

According to the embodiment of the present invention, in particular, the air duct 215 is disposed in the rear wall 211 of the main door 210, and the cold air is introduced into the dry storage portion 400 through the air duct 215. When the cold air flows through the air duct 215, the water vapor in the cold air condenses on the inner wall of the air duct 215, so that the stripping of moisture is realized, and the cold air flowing into the dry storage portion 400 is dry air. Due to adoption of such a simple structure, the present invention completes a drying process during the delivery of the cold air to the dry storage portion 400; and the water vapor naturally condenses in the drying process, and no other additional structures are required, so that the design is very ingenious. Moreover, the second chamber 201 is formed in the main door 210, its volume is very limited, and the volume of the dry storage portion 400 is smaller, so there is no need for the air duct 215 to have a very large flow area. Therefore, formation of the air duct 215 has little effect on the thickness of the rear wall 211 of the main door 210, and will not occupy the storage space of the second chamber 201.

In some embodiments, as shown in FIGS. 2 to 4, the second chamber 201 is internally provided with a moisture storage portion 500. The relative humidity of the air in the moisture storage portion 500 is relatively high, so that the moisture storage portion 500 is used for storing refrigerated articles that require an environment with higher humidity. An atomizing device 600 is disposed downstream of the air duct 215 to atomize the condensed water accumulated by condensation on the inner wall of the air duct 215. The air duct 215 is configured to introduce the cold air mixed with mist into the moisture storage portion 500. The moisture storage portion 500 may be a drawer. The atomizing device 600 can be selected from an ultrasonic atomizer, a compression atomizer or a mesh atomizer commonly used in the field of atomization, and details are not repeated here.

As shown in FIG. 2, an inlet of the air duct 215 can be reserved in an upper part of the rear wall 211, so that the cold air flows from top to bottom in the air duct 215 due to its higher density. Thus, the upstream of the air duct 215 refers to an upper part of the air duct 215, and the downstream thereof refers to a lower part of the air duct 215. The atomizing device 600 is disposed at a bottom of the air duct 215, and the inner wall condensation of the air duct 215 flows downward to the bottom of the air duct 215 under the action of gravity and is then atomized by the atomizing device 600. The moisture storage portion 500 is disposed below the dry storage portion 400 and opposite to the bottom of the air duct 215 to directly receive a high-humidity air flow.

As shown in FIG. 4, the air duct 215 is also internally provided with an air baffle 2116, and communication points between the dry storage portion 400 and the air duct 215 as well as between the moisture storage portion 500 and the air duct 215 are respectively located upstream and downstream of the air baffle 2116; and the air baffle 2116 is spaced apart from the rear shell 2114 to allow the condensation water and part of the cold air to flow in a downstream direction of the air baffle 2116. That is, the function of the air baffle 2116 is to isolate dry air and high-humidity air, and only allow the condensed water of the rear wall 211 of the air duct 215 to flow downstream.

According to the embodiment of the present invention, the second chamber 201 is internally provided with not only the dry storage portion 400 but also the moisture storage portion 500. Moreover, the present invention uses the atomizing device 600 to atomize the condensation of the air duct 215, so that the atomized condensation humidifies the cold air in the air duct 215 and the humidified cold air is supplied to the moisture storage portion 500. This process just recycles and utilizes the condensed water produced in a dry air preparation process, which realizes the organic combination of a drying process and a humidification process of the cold air, thus achieving the separation and extraction of dry and wet cold air, and omitting the additional dehumidification and humidification structure design as well as control program design; and therefore, the present invention is lower in cost, better in the effect, and suitable for mass production promotion. In addition, the more condensation during the drying process, the drier the obtained dry air; and furthermore, the more condensed water accumulated, the wetter the finally obtained humidified air. It can be seen that the drying process and the humidification process of the cold air are in a mutually promoting relationship, so that the drying and humidifying effects are very good.

In some embodiments, as shown in FIG. 2 and FIG. 3, the dry storage portion 400 can be configured to return air to the second chamber 201, and an internal space of the moisture storage portion 500 is isolated from the second chamber 201. Specifically, a dry air return port 420 which is open to the rear can be reserved at a bottom of a rear side of the dry storage portion 400 for discharging the air. The moisture storage portion 500 is only provided with a moisture ventilation opening 510 communicated with the air duct 215. According to the embodiment, the air return ways of the dry storage portion 400 and the moisture storage portion 500 are designed differently, so that the relative dry gas in the dry storage portion 400 can enter the second chamber 201, and the high-humidity gas of the moisture storage portion 500 is prevented from entering the second chamber 201, thus avoiding the condensation problem caused by the rising humidity in the second chamber 201.

In some embodiments, as shown in FIGS. 2 and 3, a front air outlet 122 communicated with a cooling room 102 of the refrigerator is formed in the inner wall of the refrigerator body 100. The front air outlet 122 is communicated with the cooling room 102 through a main air duct 120. The front air outlet 122 is adjacent to the rear shell 2114 to discharge air towards the rear surface of the rear shell 2114, so that the rear shell 2114 is cooled, and the temperature of the rear shell 2114 is lower; and therefore, the condensation process of the front surface of the rear shell 2114 (i.e., the rear wall 211 of the air duct 215) is facilitated, and the cold air supplied to the dry storage portion 400 is accordingly drier. The front air outlet 122 can be reserved in a front part of a top wall of the refrigerator body 100 to be closer to the rear shell 2114, which is more conducive to air supply to the rear shell 2114. A second fan 320 can be installed at the front air outlet 122 for blowing down.

A rear side of the refrigerator body 100 may be provided with a rear air outlet 130 communicated with the cooling room 102 for supplying air to a rear part of the first chamber 101. In this way, the air discharged out from the front air outlet 122 cools the rear surface of the rear shell 2114 and a front space of the first chamber 101 at the same time, thus avoiding unfavorable cooling of the front space of the first chamber 101 caused by only supplying air to the rear wall 211 of the refrigerator body 100, and making the temperature of the front and rear of the first chamber 101 more uniform.

In some embodiments, as shown in FIGS. 2 and 3, the air supply port 212 can be located on the top of the rear wall 211, and the top of the air duct 215 is communicated with the air supply port 212 to allow the cold air of the first chamber 101 to enter the second chamber 201 and the air duct 215 through the air supply port 212. In this way, the air duct 215 is communicated with the first chamber 101 via the air supply port 212, and there is no need for a separate opening in the rear shell 2114, which simplifies the structure of the rear shell 2114. The air return port 214 may be reserved in the bottom of the rear wall 211.

Further, the front air outlet 122 communicated with the cooling room 102 of the refrigerator is formed in the front part of the top wall of the refrigerator body 100, and the front air outlet 122 is configured to supply air to the rear surface of the rear shell 2114 and the air supply port 212 at the same time. The cold air blown out from the front air outlet 122 comes from the cooling room 102, and the temperature of the cold air is lower than that of the first chamber 101. Therefore, in the embodiment, part of the cold air is blown toward the air supply port 212, so that it enters the air duct 215 and the second chamber 201, which is very beneficial for the refrigeration of the second chamber 201 and the formation of condensation on the inner wall of the air duct 215.

Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

What is claimed is:

1. A refrigerator, comprising a refrigerator body and a door body, wherein a front side of the refrigerator body is open to define a first chamber, and the door body comprises a main door used for opening and closing the first chamber, and defining a second chamber, and a secondary door used for opening and closing the second chamber, wherein a rear wall of the main door is provided with an air supply port used for introducing air in the first chamber into the second chamber, and an air return port used for allowing to return air in the second chamber to the first chamber, the second chamber being internally provided with a dry storage portion; and the rear wall of the main door comprises a front shell and a rear shell spaced apart from each other front and back, an air duct is defined between the front shell and the rear shell, and the air duct is configured to introduce cold air prepared in the refrigerator, so that the cold air is condensed on an inner wall of the air duct, becomes dry gas, and then flows into the dry storage portion, wherein the second chamber is internally provided with a moisture storage portion;

an atomizing device is disposed downstream of the air duct to atomize condensed water accumulated by condensation on the inner wall of the air duct; and the air duct is configured to introduce the cold air mixed with mist into the moisture storage portion.

2. The refrigerator according to claim 1, wherein the air duct is internally provided with an air baffle, and communication points between the dry storage portion and the air duct as well as between the moisture storage portion and the air duct are respectively located upstream and downstream of the air baffle; and the air baffle is spaced apart from the rear shell to allow condensation water and part of the cold air to flow in a downstream direction of the air baffle.

3. The refrigerator according to claim 1, wherein the dry storage portion is configured to return air to the second chamber; and an internal space of the moisture storage portion is isolated from the second chamber.

4. The refrigerator according to claim 1, wherein a front air outlet communicated with a cooling room of the refrigerator is formed in an inner wall of the refrigerator body, and the front air outlet is adjacent to the rear shell to discharge air toward a rear surface of the rear shell, so that the rear shell is cooled.

5. The refrigerator according to claim 4, wherein the front air outlet is reserved in a front part of a top wall of the refrigerator body.

6. The refrigerator according to claim 5, wherein a rear air outlet communicated with the cooling room is formed at a rear side of the refrigerator body to supply air to a rear part of the first chamber.

7. The refrigerator according to claim 1, wherein the air supply port is located at a top of the rear wall, and a top of the air duct is communicated with the air supply port to allow the cold air of the first chamber to enter the second chamber and the air duct through the air supply port.

8. The refrigerator according to claim 7, wherein a front air outlet communicated with a cooling room of the refrigerator is formed in a front part of a top wall of the refrigerator body, and the front air outlet is configured to supply air to a rear surface of the rear shell and the air supply port at the same time.

9. The refrigerator according to claim 1, wherein the rear shell is made of a metal material.

* * * * *